United States Patent [19]

Hoekstra

[11] Patent Number: 5,035,053

[45] Date of Patent: Jul. 30, 1991

[54] SHAVING APPARATUS

[75] Inventor: Albert Hoekstra, Drachten, Netherlands

[73] Assignee: U.S. Philips Corp., New York, N.Y.

[21] Appl. No.: 639,320

[22] Filed: Jan. 9, 1991

Related U.S. Application Data

[63] Continuation of Ser. No. 404,915, Sep. 8, 1989, abandoned.

[30] Foreign Application Priority Data

Sep. 19, 1988 [NL] Netherlands ..... 8802311

[51] Int. Cl.[5] ..... B26B 19/14

[52] U.S. Cl. ..... 30/43.6

[58] Field of Search ..... 30/43.5, 43.6, 43, 34.2, 30/32, 43.1

[56] References Cited

U.S. PATENT DOCUMENTS

| | | | |
|---|---|---|---|
| 3,362,069 | 1/1968 | Blackwell | 30/329 |
| 3,710,442 | 1/1973 | Meyer | 30/43.6 |
| 4,707,915 | 11/1987 | Bakker et al. | 30/43.6 |

*Primary Examiner*—Timothy V. Eley
*Assistant Examiner*—Willmon Fridie, Jr.
*Attorney, Agent, or Firm*—Ernestine C. Bartlett

[57] ABSTRACT

A shaving apparatus comprises an external shaving member having hair-entry apertures and an internal shaving member which is drivable relative to the external shaving member and which comprises a carrier for at least one cutter, a portion of the cutter being disposed in a recess in the carrier. The cutter is supported by the carrier by means of three supporting projections which are not disposed in line.

8 Claims, 2 Drawing Sheets

SHAVING APPARATUS

This is a continuation of application Ser. No. 404,915, filed Sept. 8, 1989, now abandoned.

FIELD OF THE INVENTION

The invention relates to a shaving apparatus, comprising an external shaving member formed with hair-entry apertures and an internal shaving member which is drivable relative to the external shaving member and which comprises a carrier for at least one cutter, a portion of the cutter being disposed in a recess in the carrier.

BACKGROUND OF THE INVENTION

Such a shaving apparatus is known for example from U.S. Pat. No. 3,890,709. During shaving the cutter will lie against the carrier at some locations, causing the cutter to be clamped in the carrier as a result of prevailing frictional forces, as is also described in U.S. Pat. No. 3,636,628.

The locations where a cutter is in contact with the carrier will not always be the same as a result of dimensional tolerances of the internal shaving member and manufacturing inaccuracies. Consequently the clamping action between the carrier and the cutter will not always be the same for different cutters.

SUMMARY OF THE INVENTION

An object of the invention is to achieve a most effective clamping action between the carrier and the cutter, so as to preclude a displacement of the cutter relative to the carrier during shaving, which clamping action is substantially constant for different cutters, and to this end the invention is characterized in that the cutter is made to engage against the carrier by means of three supporting projections which are not disposed in line.

In preferred embodiments the supporting projections are formed by protuberances in the cutter which is made of a sheet material; the supporting projections are arranged in a triangular pattern with the apex of the triangle pointing away from the external shaving member; the cutter comprises a plate-shaped body which is disposed in the recess in the carrier and the supporting projections are arranged at opposite sides of the plate-shaped body; or the supporting projections are formed on the carrier.

DETAILED DESCRIPTION OF PREFERRED EMBODIMENT

An embodiment of the invention will now be described in more detail, by way of example, with reference to the Figures.

Figure 1:
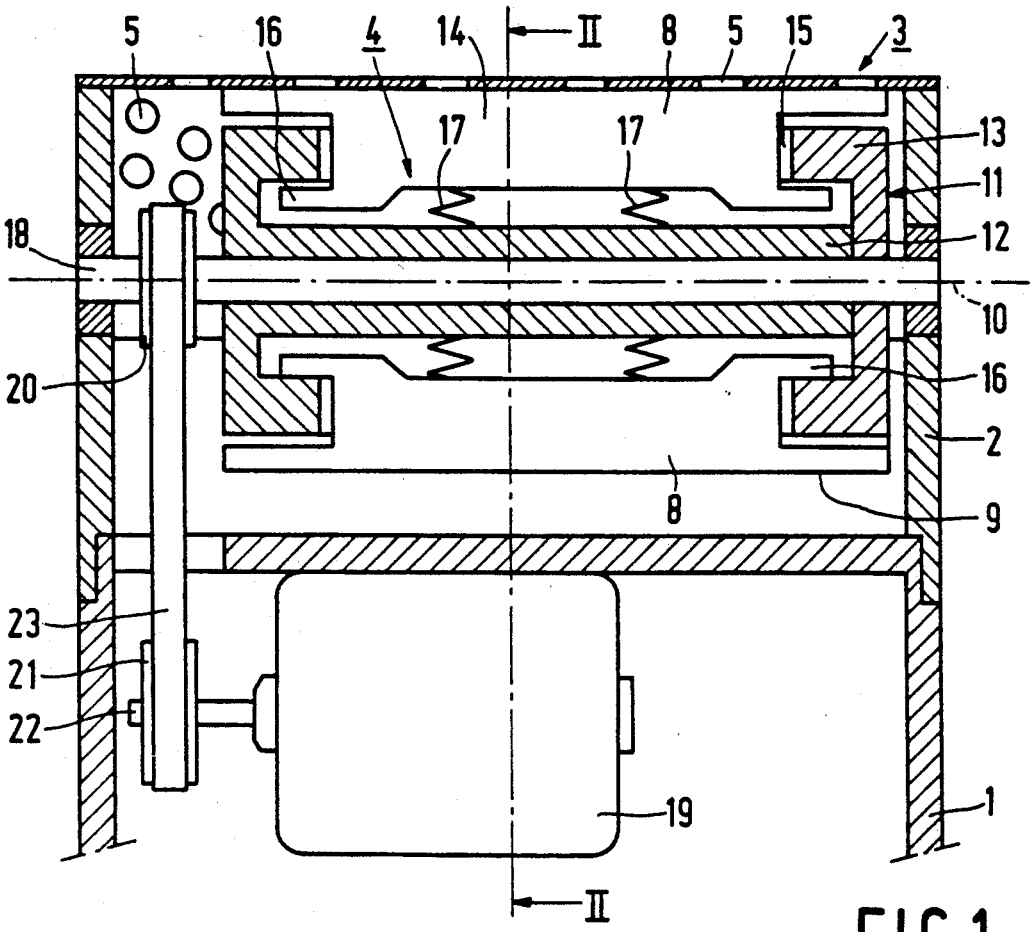
FIG. 1 is a diagrammatic longitudinal section view of a shaving apparatus in accordance with the invention.
Figure 2:
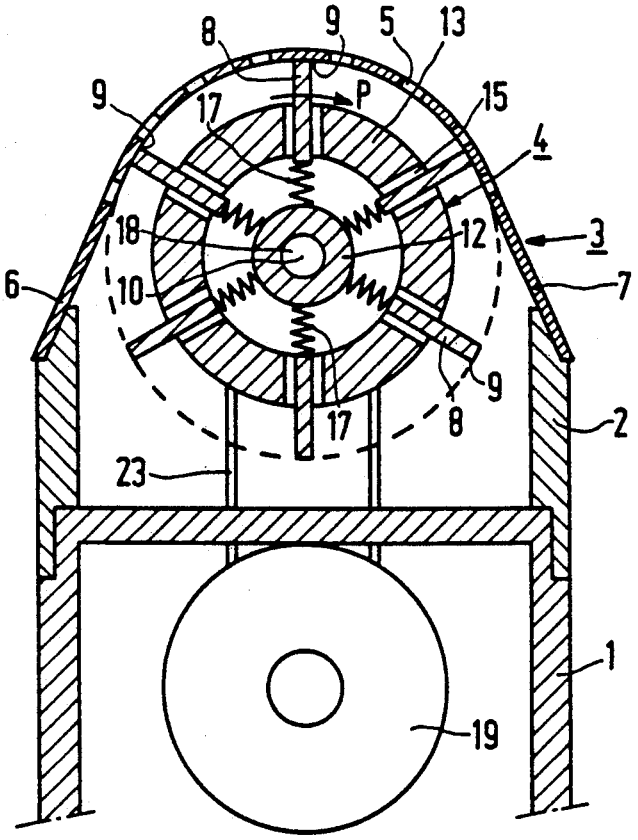
FIG. 2 is a sectional view taken on the line II—II in FIG. 1.

The shaving apparatus shown in FIGS. 1 and 2 comprises a housing 1 having a holder 2 for an external shaving member 3 and an internal shaving member 4 which is rotatable relative to the external shaving member.

The external shaving member 3 is formed with hair-entry apertures 5 and also comprises a first edge portion 6 and a second edge portion 7, by which the external shaving member 3 is secured to the holder 2.

The internal shaving member 4 comprises cutters 8 having cutting edges 9 at their ends. The internal shaving member 4 is supported in the holder 2 so as to be rotatable about the axis of rotation 10 and is partly surrounded by the external shaving member 3. Hairs which project inwardly through the hair-entry apertures can now be severed by cooperation between the external shaving member 3 and the cutting edges 9 of the cutters 8, which edges slide along the inner side of the external shaving member.

The internal shaving member 4 comprises a carrier 11 for the cutters 8, which carrier comprises a hub 12 and a cylindrical portion 13. Each cutter 8 comprises a portion 14 which engages in a substantially radially oriented recess 15 in the cylindrical portion 13 of the carrier. A cutter 8 is movable over a limited distance in a substantially radial direction relative to the carrier. The hook-shaped end portions 16 of the cutters are disposed between the hub 12 and the cylindrical portion 13 to prevent the cutters 8 from falling out of the carrier 11. Compression springs 17 arranged between the hub 12 and the cutters 8 exert outwardly directed radial forces on the cutters 8.

The hub 12 is secured to the shaft 18 which is journalled in the holder 2 so as to be rotatable about the axis of rotation 10. The housing 1 accommodates the electric motor 19 for driving the internal shaving member 4, for example in a direction of rotation as indicated by the arrow P (FIG. 2). The rotation of the motor 19 is transmitted to the shaving member 4 by means of the pulleys 20 and 21 on the shaft 18 and the motor shaft 22 respectively and the drive belt 23.

Figure 3:
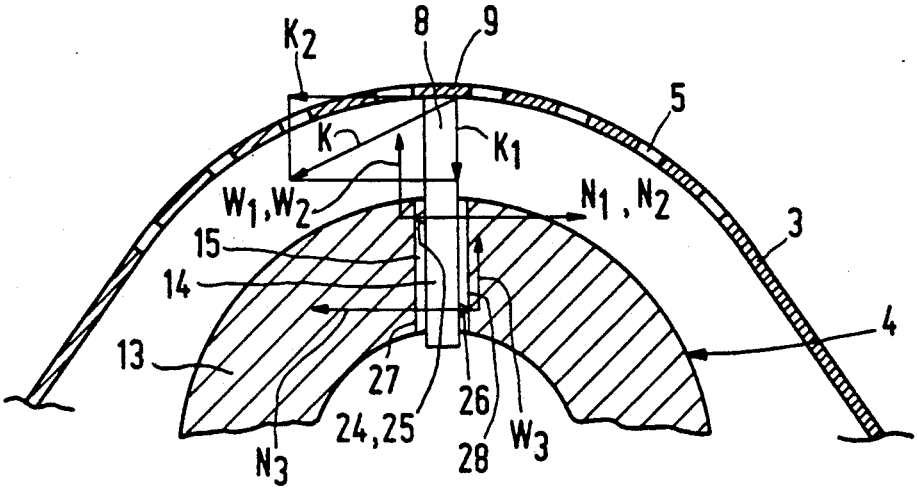
FIG. 3 shows a part of the sectional view of FIG. 2 to an enlarged scale.
Figure 4:
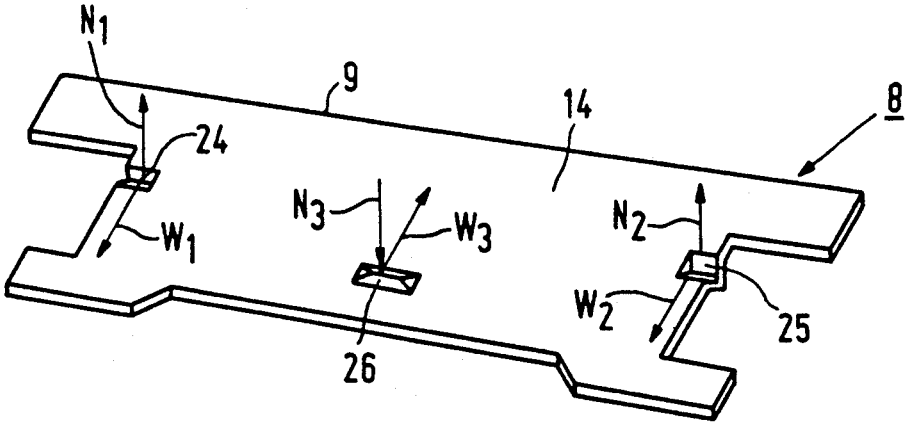
FIG. 4 is a perspective view of a cutter.

The portion 14 of a cutter 8 (FIGS. 3 and 4) is provided with three supporting projections 24, 25 and 26 which are not disposed in line. If the cutter is made of a sheet material these projections 24, 25 and 26 can be formed simply by local protuberances of the material. The supporting projections 24 and 25 engage against the wall 27 of the recess 15 and the supporting projection 26 engages against the opposite wall 28 of said recess (FIG. 3).

If during use of the apparatus a hair is caught in a hair-entry aperture 5 the cutting edge 9 at the end portion of the cutter 8 will penetrate the hair and the hair will exert a reactive force on the cutter. This force K which acts on the cutter during shaving will have a component $K_1$ in the longitudinal direction of the recess 15 and a component $K_2$ perpendicular thereto (FIG. 3). The component $K_2$ will give rise to reactive forces $N_1$ and $N_2$ in the supporting projections 24 and 25, respectively which forces act on the cutter and in the supporting projection 26 a reactive force $N_3$ will occur. The reactive forces $N_1$, $N_2$ and $N_3$ will give rise to frictional forces $W_1$, $W_2$ and $W_3$ (see also FIG. 4) which prevent the cutter from being pressed away from the external shaving member 3 by the component $K_1$. The use of these three supporting projections 24, 25 and 26 unambiguously defines the position of the cutter 8 relative to the carrier 11 and the points where these frictional forces $W_1$, $W_2$ and $W_3$ act can be located so as to optimize the clamping action.

The force K can occur at an arbitrary location along the cutting edge 9. In order to eliminate torque which is exerted on the cutter 8 by the force $K_1$ and which tends to twist the cutter in the plane of the plate-shaped portion 14, it is important that the supporting projection 24 and 25 are spaced apart as far as possible. Generally, the supporting projections will be arranged in a triangular pattern, the apex of the triangle pointing away from the external shaving member.

In particular in a shaving apparatus of the type described above, which comprises a cylindrical internal shaving member having cutters of comparatively large axial dimensions, three supporting, projections will provide a uniform and effective support of the cutters in the carrier.

Obviously it is also possible to construct the supporting projections as parts of the carrier.

What is claimed is:

1. A shaving apparatus, comprising an external shaving member formed with hair-entry apertures and an internal shaving member which is drivable relative to the external shaving member and which comprises a carrier for at least one cutter, a portion of the cutter being disposed in a recess in the carrier, wherein said portion of the cutter is made to engage against the carrier by means of three supporting projections formed in said cutter surface which are not disposed in line, said projections engaging walls of said recess in the carrier thereby effecting a clamping action between the carrier and the cutter so as to preclude substantial displacement of the cutter relative to the carrier during shaving.

2. A shaving apparatus as claimed in claim 1, wherein the supporting projections are formed by protruberances in the cutter which is made of a sheet material.

3. A shaving apparatus as claimed in claim 1 or 2, wherein said supporting projections are arranged in a triangular pattern, wherein the apex of the triangle points away from the external shaving member.

4. A shaving apparatus as claimed in claim 1 wherein, the cutter comprises a plate-shaped body which is disposed in a recess in the carrier and the supporting projections are arranged at opposite sides of the plate-shaped body.

5. A shaving apparatus as claimed in claim 1, wherein the supporting projections are formed on the carrier.

6. A shaving apparatus comprising an external shaving member formed with hair-entry apertures and an internal shaving member which is drivable relative to the external shaving member and which comprises a carrier for at least one cutter comprising a plate-shaped body, a portion of which is disposed in a recess in the carrier, wherein the cutter is made to engage against the carrier by three supporting projections formed on opposite sides of said plate-shaped body, said supporting projections being formed by protuberances in the cutter plate-shaped body arranged in a triangular pattern wherein the apex of the triangle points away from the external shaving member and said supporting projections effecting a clamping action between the carrier and the cutter so as to preclude substantial displacement of the cutter relative to the carrier during shaving.

7. A shaving apparatus as claimed in claim 6 wherein the supporting projections are formed on the carrier.

8. A shaving apparatus as claimed in claim 6 wherein the cutter is made of a sheet material.

* * * * *